US007669430B2

(12) United States Patent
Matsui et al.

(10) Patent No.: US 7,669,430 B2
(45) Date of Patent: Mar. 2, 2010

(54) HEAT PUMP APPARATUS

(75) Inventors: Keizo Matsui, Hyogo (JP); Hiroshi Hasegawa, Osaka (JP); Fumitoshi Nishiwaki, Hyogo (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 526 days.

(21) Appl. No.: 10/564,033

(22) PCT Filed: Apr. 26, 2005

(86) PCT No.: PCT/JP2005/007898

§ 371 (c)(1),
(2), (4) Date: Mar. 26, 2007

(87) PCT Pub. No.: WO2005/103584

PCT Pub. Date: Nov. 3, 2005

(65) Prior Publication Data

US 2007/0266720 A1 Nov. 22, 2007

(30) Foreign Application Priority Data

Apr. 27, 2004 (JP) ..... 2004-130567

(51) Int. Cl.
*F25B 9/00* (2006.01)

(52) U.S. Cl. ..... 62/87; 62/158; 62/402

(58) Field of Classification Search ..... 62/87, 62/402, 458

See application file for complete search history.

(56) References Cited

U.S. PATENT DOCUMENTS

2006/0250114 A1* 11/2006 Faberman et al. ..... 322/24
2007/0101735 A1* 5/2007 Matsui et al. ..... 62/160

FOREIGN PATENT DOCUMENTS

JP 2004-144399 5/2004

OTHER PUBLICATIONS

"Energy effective use base technique research and development, development of two-phase expander and compressor for CO2 air-conditioner;" Fruition report of 2002; Report (to be public) Mar. 2003; New Energy Industrial and Technology Development Organization (and partial English translation).

* cited by examiner

*Primary Examiner*—Sam Chuan C Yao
*Assistant Examiner*—Jonathan Bradford
(74) *Attorney, Agent, or Firm*—Kratz, Quintos & Hanson, LLP

(57) ABSTRACT

The present invention realizes a reliable heat pump apparatus and heat pump apparatus having high recovering efficiency. The heat pump apparatus includes an expander 711 for expanding working fluid, a permanent magnet type synchronization power generator 710 which is disposed for recovering power by the expander 711 and which generates three phase AC power, and a first converter 708 which converts the AC power to DC power, and which rotates the power generator 710 at a predetermined target number of revolutions by switching of a switching element group 709. The generated electricity is consumed by connection of an AC power supply 701 to a DC power line which is rectified and smoothened by a rectifier circuit 702 and a smoothing capacitor 703, and by driving of an electric motor 706 which rotates a compressor 707 through a motor drive apparatus 704, and the power is efficiently recovered.

7 Claims, 10 Drawing Sheets

HEAT PUMP APPARATUS

TECHNICAL FIELD

The present invention relates to a heat pump apparatus in which a power generator is connected to an expander to recover power.

BACKGROUND TECHNIQUE

FIG. 10 shows a general conventional vapor-compression type refrigerator. The vapor-compression type refrigerator shown in FIG. 10 comprises a compressor 101, a radiator 102, an expansion valve 103 and an evaporator 104. These members are connected to one another through pipes, and refrigerant is circulated as shown with hollow arrows in the drawing.

The operation principle of the vapor-compression type refrigerator is as follows. The pressure and temperature of the refrigerant are increased by the compressor 101, the refrigerant enters radiator 102 and is cooled. Then, the high pressure refrigerant is compressed under the vapor pressure by the expansion valve 103, heat of the refrigerant is absorbed by the evaporator 104 and the refrigerant is vaporized. The refrigerant coming out from the evaporator 104 returns to the compressor 101. In this apparatus, carbon dioxide which does not destroy the ozone layer and has extremely small global warming coefficient is used as the refrigerant.

However, as compared with a refrigerator using commonly used flon as the refrigerant, the vapor-compression type refrigerator using carbon dioxide as the refrigerant has lower coefficient of performance (COP) which is energy efficiency. When both the refrigerators have the same refrigeration abilities, the vapor-compression type refrigerator needs more electricity than the refrigerator using flon as the refrigerant. Thus, more fossil fuel is required as energy, and even if the global warming coefficient of the refrigerant itself is small, more carbon dioxide is discharged as a result. Therefore, it is necessary to enhance the COP of the vapor-compression type refrigerator using carbon dioxide as the refrigerant, and various configurations and methods have been proposed.

The following apparatus for enhancing the COP have been proposed (patent documents 1 to 3). In a refrigerator shown in FIG. 11, a compressor 201 is driven by a prime mover 205, a refrigerant compressed by the compressor 201 is cooled by a radiator 202 and then, the refrigerant passes through an expander 204 on which an expansion ratio controller 203 is mounted. The expander 204 assists the compressor 201 in driving through a main shaft 213. The refrigerant expands in the expander 204, heat of the refrigerant is absorbed from outside in the evaporator and vaporized and then, the refrigerant returns to the compressor 201. The compressor 201, the radiator 202, the expander 204 and the evaporator 206 are connected to each other through a pipe 207 and constitute a circuit. To enhance the performance and reliability, an oil separator 208 and an accumulator 209 are provided in some cases.

The expansion ratio controller 203 is controlled by calculation means 210. A temperature sensor 211 and a pressure sensor 212 are mounted for detecting a state of a refrigerant on the side of an outlet as input to the calculation means 210.

In the refrigerator having such a configuration, since the driving operation of the compressor 201 is assisted by an expanding force of the refrigerant by using the expander 204, the total amount of energy to be used is reduced, and the COP can be enhanced.

That is, when the conventional expansion valve is used as the expanding means like a pressure—enthalpy state diagram, i.e., a so-called Mollier diagram which shows a state of a refrigerant in a refrigeration cycle using carbon dioxide as the refrigerant, the refrigerant is equally enthalpy expanded, but it is equally entropy expanded (shown with dotted lines) by the expander, and power recovered by the expander is utilized, thus, the total efficiency can be enhanced.

In a refrigerator shown in FIG. 13, a compressor 401 is driven by a prime mover 405, a refrigerant compressed by the compressor 401 is cooled by a radiator 402 and then, when the refrigerant passes through an expander 403, a power generator 404 connected to the expander 403 generates electricity (patent documents 1 and 2). Then, the refrigerant expands in the expander 403, heat of the refrigerant is absorbed from outside in an evaporator 406 and the refrigerant is vaporized and then, the refrigerant again returns to the compressor 401.

According to this apparatus, the expansion force of the refrigerant rotates the power generator 404 to generate electricity. Since this electricity is utilized, the total energy to be used can be reduced, thereby enhancing the COP.

As such a power generator 404, an exciting apparatus is used (patent document 4). FIGS. 14 and 15 show a refrigerator disclosed in patent document 4. As shown in FIG. 14, according to this refrigerator, refrigerant is circulated through a compressor 501, a condenser 502, a liquid receiver 503, an expander 504, and an evaporator 505 in this order. The expander 504 is provided with a power generator 506 coaxially connected to its drive shaft. The refrigerator comprises a superheat detector 512 provided in an outlet of the evaporator 505 for detecting a superheat of the refrigerant, a controller 511 for controlling exciting current of the power generator 506 based on a signal of the superheat detector 512, a rectifier 508 for converting AC generated by the power generator 506 into DC, and a capacitor 510 for recovering DC electricity.

In the case of this refrigerator, the exciting current (i.e., current amount flowing through an exciting coil) of the power generator 506 is adjusted to control the power generator 506, a torque of a load of the power generator 506 is increased or reduced to control the rotation of the expander 504, thereby adjusting the flow rate of the refrigerant, and recovering the electricity generated by the power generator 506 efficiently into a capacitor 510.

The power generator 506 inputs a driving force by a drive shaft foxed to the other end of a rotor to generate electricity. The power generator 506 is provided with a brush. The brush slides on a slip ring and supplies exciting current to a rotor coil. If the expansion rotation of the refrigerant rotates the drive shaft, a magnetic field is produced by exciting current supplied to a rotor coil, an electromotive force is generated in a stator coil, and the electromotive force is output by the stator coil as AC power.

An exciting unit 507 for producing the exciting current of the power generator 506 has a circuit configuration shown in FIG. 15. The exciting unit 507 supplies, to the power generator 506, an exciting current control signal which is output from a controller 511 as an input signal, and exciting current from the exciting unit 507 as an output signal.

That is, an exciting current control signal which is output from a controller 511 is applied to a base of a npn-type transistor Tr604 (Tr604, hereinafter). An emitter of the Tr604 is connected to a minus terminal of the power generator 506, and a collector of the Tr604 is connected to a rotor coil 602 of the power generator 506 through a resistor 605. A base of a transistor Tr603 (Tr603, hereinafter) is connected to a collector of the Tr604, an emitter of the Tr603 is connected to a minus terminal of the power generator 506, and a collector of the Tr603 is connected to a plus terminal of the power generator 506. With this, if the exciting current control signal applied to the base of the Tr604 from the controller 511 is increased, the Tr604 is brought into conduction and the exciting current flowing through the rotor coil 602 is increased, and if the exciting current control signal applied to the base of the Tr604 is reduced, the exciting current is reduced.

The controller 511 which outputs the exciting current control signal controls the exciting current control signal which is output to the exciting unit 507 such that the flow rate of the refrigerant becomes the appropriate value based on temperature information of the refrigeration cycle. For example, when a circulation amount of refrigerant is small, the exciting current of the power generator 506 is reduced, the load torque is reduced, and the number of revolutions of the expander 504 is increased. When the circulation amount is large on the other hand, the exciting current of the power generator 506 is increased, the load torque is increased, and the number of revolutions of the power generator 506 is reduced. Further, AC generated by the power generator 506 is converted into DC through the rectifier 508, a charging voltage is controlled substantially constant through a variable load resistor 509, and charges the capacitor 510 is charged with electricity.

The exciting current is controlled by the power generator 506 having the rotor coil 602 and the exciting unit 507 which supplies the exciting current to the rotor coil 602, thereby controlling the number of revolutions of the expander 504.

A patent document 5 describes a wind power generator in which an output of a permanent magnet type synchronization power generator connected to a windmill through a shaft is converted by using an AC-DC converter (variable-speed inverter), and a variable-speed inverter is controlled, thereby controlling the output voltage of the power generator and variable-speed of the number of revolutions of the power generator.

Further, a patent document 6 describes a magnetic pole position is estimated by a position estimating device from output current and terminal voltage of a permanent magnet type synchronization power generator, and then, a torque of the power generator is controlled.

[Patent Document 1] Japanese Patent Application Laid-open No. 2000-241033

[Patent Document 2] Japanese Patent Application Laid-open No. 2000-249411

[Patent Document 3] Japanese Patent Application Laid-open No. 2001-165513

[Patent Document 4] Japanese Patent Application Laid-open No. H1-168518

[Patent Document 5] Japanese Patent Application Laid-open No. 2000-345952

[Patent Document 6] Japanese Patent Application Laid-open No. 2002-354896

However, in the case of the configuration described in the patent document 4, since a rotor of the power generator includes an exciting unit and a coil, its weight is increased, and its configuration is complicated. Further, since current flows through the exciting unit, there is electricity loss in the rotor, and the power generation efficiency is low.

Further, since the number of revolutions of the power generator is controlled by adjusting the exciting current, in the case which the number of revolutions exceeds the adjusting range of a narrow exciting current, the expander can not be controlled. Thus, it is difficult to optimize the refrigeration cycle, and the efficiency of the refrigeration cycle can not be optimized.

In the case of the control of the power generator described in a cited document 5, since the rotor does not have an exciting element and a coil, the weight on the side of the rotor is reduced, current loss in the rotor is reduced and thus, the power generating efficiency is enhanced, but there is no description concerning a method for detecting a position of the magnetic pole of the power generator. When a permanent magnet type synchronization power generator having no exciting unit is used, in order to control the power generator, it is necessary to detect the position of the magnetic pole of the power generator. To detect the magnetic pole position of the power generator, it is conventionally necessary to use a rotation position sensor such as an encoder. Thus, when the encoder and the power generator are integrally formed, it is necessary to bring a rotation shaft out from a shell for the encoder. To this end, a countermeasure such as a shaft seal against the pressure is required, and the reliability is deteriorated.

In a wind power generator and the like, in order to constantly maintain DC irrespective of the rotation speed of the permanent magnet type synchronization power generator, patent document 6 discloses a technique in which a magnetic pole position is estimated using current without using an encoder, thereby controlling the power generator. In a heat pump apparatus, however, in addition to merely maximize the output of the power generator, it is required to control to optimize the efficiency of the refrigeration cycle while efficiently utilizing the output of the power generator.

Further, at the time of actuation, the expander can not forcibly be rotated, and the reliability of the refrigeration cycle is deteriorated.

Therefore, the present invention has been accomplished to solve these problems, and it is an object of the invention to provide a heat pump apparatus in which the weight on the side of a rotor is reduced, the rotor does not have an exciting unit and a coil and thus, since electricity does not flow through the exciting unit and coil, there is no electricity loss in the rotor, the power generating efficiency is enhanced, the configuration on the side of the rotor is simple, the cost thereof is reduced, and the usefulness of the power generator can be utilized.

It is another object to provide an efficient and reliable heat pump apparatus. That is, an expander can be controlled with a wide number of revolutions, the efficiency is optimized, a permanent magnet type synchronization power generator can be controlled without the rotation position sensor, the reliability is enhanced in terms of sealing ability, the expander can be rotated forcibly at the time of actuation thereof, the actuation performance is enhanced, and the reliability of the refrigeration cycle is enhanced.

DISCLOSURE OF THE INVENTION

A first aspect of the present invention provides a heat pump apparatus comprising a compressor for compressing a refrigerant, a radiator for cooling the refrigerant compressed by the compressor, an expander for expanding the refrigerant which passed through the radiator, an evaporator for vaporizing the refrigerant which is expanded by the expander, a refrigerant pipe for circulating the refrigerant through the compressor, the radiator, the expander and the evaporator, a pressure sensor disposed between the compressor and the expander for detecting pressure of the refrigerant, a temperature sensor disposed between the compressor and the expander for detecting temperature of the refrigerant, a permanent magnet type synchronization power generator connected to the expander, a current sensor for detecting current which flows through the permanent magnet type synchronization power generator, a first converter which converts AC power which is output from the permanent magnet type synchronization power generator into DC power, which estimates a magnetic pole position of the permanent magnet type synchronization power generator by a current value detected by the current sensor, and which controls the number of revolutions of the permanent magnet type synchronization power generator to a predetermined value by using the current value and the magnetic pole position, and power generator revolution number controller for controlling the first converter by signals from the pressure sensor and the temperature sensor.

According to the first aspect, the number of revolutions of the permanent magnet type synchronization power generator is controlled to a predetermined value by the first converter, and electricity can be recovered by the permanent magnet type synchronization power generator connected to the expander. Since the permanent magnet type synchronization power generator does not have an exciting unit, the weight of the power generator is reduced, and the electricity generating efficiency is enhanced. With this, it is possible to realize an inexpensive heat pump apparatus having high total efficiency. The cycle efficiency of the heat pump apparatus can be optimized.

According to a second aspect of the invention, in the heat pump apparatus of the first aspect, the first converter estimates a magnetic pole position and the number of revolutions of the permanent magnet type synchronization power generator by a current value detected by the current sensor, and controls the current value and the number of revolutions of the permanent magnet type synchronization power generator to predetermined values by using the current value, the magnetic pole position and the number of revolutions.

According to the second aspect, it is possible to control the number of revolutions of the permanent magnet type synchronization power generator without using the rotation position sensor. Thus, the expander and the power generator can be accommodated in the same shell, and a heat pump apparatus having high reliability and sealing ability can be realized.

According to a third aspect of the invention, in the heat pump apparatus of the first aspect, the apparatus further comprises a second converter for converting AC of commercial power supply to DC, and an inverter which connects DC output from the first and second converters to an input end of the inverter to convert the DC into AC having predetermined frequency, and which drives the compressor.

According to the third aspect, the generated electricity of the expander can be utilized as electricity for driving the compressor, the configuration can be simplified, and the electricity can efficiently be recovered.

According to the fourth aspect of the invention, in the heat pump apparatus of the first aspect, the apparatus further comprises power generator current controller for controlling a current value of the power generator by signals from the pressure sensor and the temperature sensor such that the pressure of the refrigerant becomes optimal pressure.

According to the fourth aspect, the cycle efficiency of the heat pump apparatus can be optimized.

According to a fifth aspect of the invention, in the heat pump apparatus of the first aspect, the apparatus further comprises power generator current controller for controlling an amount of generated electricity of the power generator by signals from the pressure sensor and the temperature sensor such that the pressure of the refrigerant becomes optimal pressure.

According to the fifth aspect, the cycle efficiency of the heat pump apparatus can be optimized.

According to a sixth aspect of the invention, in the heat pump apparatus of the first aspect, when the expander is actuated, the power generator is driven in a power mode by the first converter.

According to the sixth aspect, the expander can be actuated smoothly when the system operation is started, and the reliability of the system can be enhanced.

According to a seventh aspect of the invention, in the heat pump apparatus of the first aspect, the power generator is operated by the first converter when a predetermined time is elapsed after the compressor is actuated.

According to the seventh aspect, the system can be actuated swiftly.

According to an eighth aspect of the invention, in the heat pump apparatus of the first aspect, the apparatus further comprises the refrigerant is carbon dioxide.

According to the eighth aspect, since reduction in coefficient of performance (COP) of the heat pump apparatus can be avoided, it can be of help in preventing the global warming by using carbon dioxide as the refrigerant.

A ninth aspect of the invention provides a power recovery apparatus comprising an expander for expanding working fluid, a permanent magnet type synchronization power generator connected to the expander, a current sensor for detecting current which flows through the permanent magnet type synchronization power generator, and a first converter which converts AC power which is output from the permanent magnet type synchronization power generator into DC power, which estimates a magnetic pole position of the permanent magnet type synchronization power generator by a current value detected by the current sensor, and which controls the number of revolutions of the permanent magnet type synchronization power generator to a predetermined value by using the current value and the magnetic pole position.

According to the ninth aspect, the number of revolutions of the permanent magnet type synchronization power generator is controlled to a predetermined value by the first converter, and electricity can be recovered by the permanent magnet type synchronization power generator connected to the expander. Since the permanent magnet type synchronization power generator does not have an exciting unit, the weight of the power generator is reduced, and the electricity generating efficiency is enhanced. With this, it is possible to realize an inexpensive heat pump apparatus having high total efficiency.

According to the heat pump apparatus of the present invention, no exciting unit is provided and thus, the weight of the power generator on the side of the rotor can be reduced. Further, according to the apparatus, since there is no electricity loss in the rotor, the power generating efficiency is enhanced, the configuration on the side of the rotor is simple, and an inexpensive power recovering system can be realized. The expander can be controlled widely through the power generator by switching control of the power generator by the first converter, and the power recovering efficiency and the refrigeration system efficiency can be enhanced.

BEST MODE FOR CARRYING OUT THE INVENTION

First Embodiment

Figure 1:
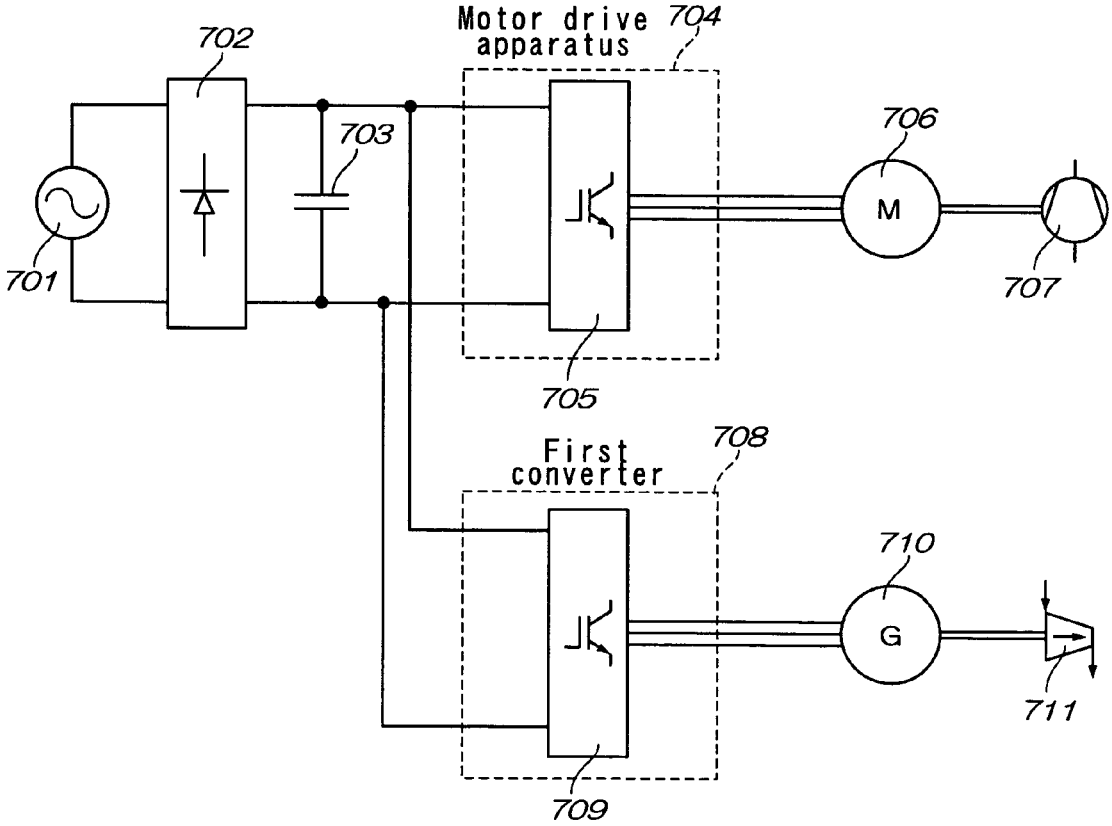
FIG. 1 is a block diagram of a heat pump apparatus according to a first embodiment of the present invention.

An embodiment of a heat pump apparatus of the present invention will be explained with reference to the drawings. FIG. 1 is a block diagram of a heat pump apparatus of a first embodiment of the invention.

The heat pump apparatus of the embodiment includes an expander 711 for expanding working fluid, a permanent magnet type synchronization power generator 710 (power generator 710, hereinafter) connected to the expander 711, and a first converter 708 which converts AC power output from the power generator 710 into DC power and which controls the driving operation of the power generator 710.

The heat pump apparatus further includes a compressor 707, an electric motor 706 for driving the compressor 707, a motor drive apparatus 704 for controlling the electric motor 706, and a power supply circuit which supplies, to the electric motor 706 through the motor drive apparatus 704, DC power converted from the AC power supply 701 by a rectifier circuit 702 and a smoothing capacitor 703 and DC power from a first converter 708.

Next, the operation of the above configuration will be explained.

In FIG. 1, voltage of the DC is rectified an input from AC power supply 701 of a commercial power supply to AC in a rectifier circuit 702, is smoothened by a smoothing capacitor 703, and then, is converted into three phase AC by a motor drive apparatus 704, thereby driving the electric motor 706. If the electric motor 706 is driven, the compressor 707 performs the compressing function. The motor drive apparatus 704 comprises a switching element group 705 for converting DC to AC. The switching element group 705 is turned ON or OFF so that it can realize a predetermined AC frequency by PWM (Pulse Width Modulation) method, and thus, arbitrary AC can be output. In this embodiment, the rectifier circuit 702 and the smoothing capacitor 703 are second converters, and the motor drive apparatus 704 corresponds to an inverter.

The power generator 710 is disposed for recovering the power by the expander 711. The first converter 708 for converting three phase AC power to DC power by the power generator 710 is connected to the power generator 710. The first converter 708 converts AC power generated by the power generator 710 into DC power, and switches a switching element group 709 provided therein by the PWM method thereby rotating the power generator 710 at a given target number of revolutions. By the function for controlling the number of revolutions of the power generator 710, it is possible to control the number of revolutions of the expander 711 through the power generator 710. With this, in the heat pump apparatus using the expander 711, the expander 711 can be driven with the optimal number of revolutions. That is, it is possible to widely control the rotation of the power generator 710, i.e., the expander 711 by the switching control of the first converter 708.

A DC output line from the first converter 708 is connected, in parallel, to a DC power line obtained from the rectifier circuit 702 through the smoothing capacitor 703. With this, electricity regenerated from the first converter 708 is consumed as driving energy of the motor drive apparatus 704.

The following equation is established:

$$Win+Wg=Wm \quad \text{(equation 1)}$$

wherein Win represents electricity which is input from the AC power supply 701 through the rectifier circuit 702, Wm represents electricity consumed by the motor drive apparatus 704, and Wg represents electricity regenerated by the first converter 708.

Here, when the compressor 707 and the expander 711 are disposed on a refrigeration cycle in the heat pump apparatus, since electricity consumption Wm of the compressor 707 is usually greater than the electricity consumption regenerated by the expander 711, the input electricity Win from the AC power supply 701 is a positive value.

Therefore, even if an output of the first converter 708 is connected to an output terminal of the second converter, regenerated electricity does not flow through the AC power supply 701. Therefore, even if a special control apparatus is not provided, the voltage of the smoothing capacitor 703 does not rise excessively. Therefore, according to the heat pump apparatus of the embodiment having such a simple configuration, electricity obtained by the power generator 710 can efficiently be recovered.

Figure 2:
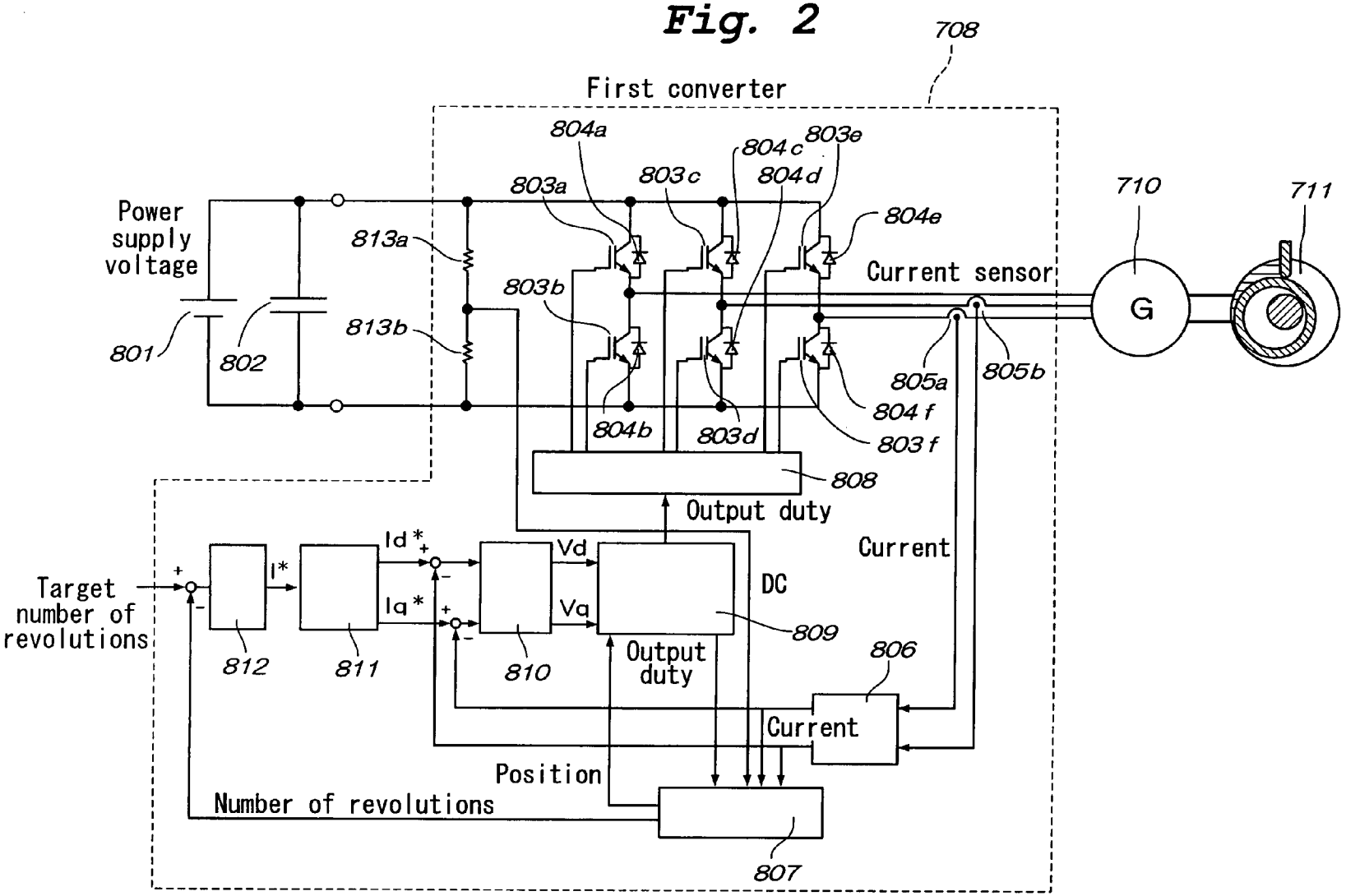
FIG. 2 is a detailed block diagram of a first converter of the heat pump apparatus shown in FIG. 1.

The configuration and operation of the first converter 708 of this embodiment will further be explained. FIG. 2 is a detailed block diagram of the first converter of the heat pump apparatus shown in FIG. 1.

The first converter 708 includes two current sensors 805*a* and 805*b*; a conversion circuit having pairs of switching elements 803*a*, 803*b*, 803*c*, 803*d*, 803*e*, 803*f* and free wheel diodes 804*a*, 804*b*, 804*c*, 804*d*, 804*e*, 804*f*; and a control circuit. The control circuit comprises a dual axis current conversion means 806, a rotor position rotation estimation means 807, a base driver 808, a sine wave voltage output means 809, a current controller 810, a current command forming means 811, and a revolution number controller 812.

The three phase AC generated output is connected such that it is supplied to a DC power supply 801 and a smoothing capacitor 802 through the first converter 708. Here, the DC power supply 801 and the smoothing capacitor 802 correspond to the rectifier circuit 702 and the smoothing capacitor 703 in FIG. 1. The three phase AC output is converted into DC by the first converter 708. At that time, the number of revolutions of the power generator 710 is controlled such that it becomes equal to the target number of revolutions based on the information of the target number of revolutions given from outside.

That is, a switching patterns of the switching elements 803*a*, 803*b*, 803*c*, 803*d*, 803*e*, 803*f* of the first converter 708 are determined by information of a magnetic pole position of the power generator 710 estimated by current information of the power generator 710 obtained from the current sensors 805*a* and 805*b*, information of number of revolutions of the power generator 710, and information of the target number of revolutions given from outside. Further, the switching pattern signal is converted into a drive signal by the base driver 808 for electrically driving the switching elements 803*a*, 803*b*, 803*c*, 803*d*, 803*e*, 803*f*, and the switching elements 803*a*, 803*b*, 803*c*, 803*d*, 803*e*, 803*f* are operated in accordance with the drive signals.

Next, the operation of the first converter 708 will be explained.

First, a current command I* is calculated by the revolution number controller 812 using the following equation (2) such from an error between a target number of revolutions ω* given from outside and current number of revolutions ω (later-described estimated number of revolutions ωm) so as to realize the target number of revolutions ω*. A general PI control method is used for the calculation method.

$$I^*=Gp\omega\times(\omega^*-\omega)+Gi\omega\times S(\omega^*-\omega) \quad \text{(equation 2)}$$

wherein, Gpω and Giω represent speed control proportion gain and integration gain, ω represents number of revolutions, ω* represents target number of revolutions, and I* represent current command.

Further, the current command forming means 811 calculates d-axis current command Id* and q-axis current command Iq* for realizing a current phase angle from the calculated current command value I* using the following equations.

$$Id^*=I^*\times\sin(\beta) \quad \text{(equation 3)}$$

$$Iq^*=I^*\times\cos(\beta) \quad \text{(equation 4)}$$

wherein, β represents current phase angle.

On the other hand, phase currents Iu and Iv of the power generator 710 detected by the current sensors 805*a* and 805*b* are converted into dual axis currents of a q-axis current Iq which contributes magnet torque of the power generator 710 and a d-axis current Id which is perpendicular to the q-axis current Iq by the following equation (5).

$$i_a=\sqrt{\frac{3}{2}}\times i_u \quad \text{(equation 5)}$$

$$i_b=\sqrt{\frac{1}{2}}\times(i_u+2\times i_v)$$

$$\begin{bmatrix} i_d \\ i_q \end{bmatrix}=\begin{bmatrix} \cos(\theta) & \sin(\theta) \\ -\sin(\theta) & \cos(\theta) \end{bmatrix}\begin{bmatrix} i_a \\ i_b \end{bmatrix}$$

Here, θ represents rotor position (magnetic pole position of power generator).

The current controller 810 uses the current commands Id* and Iq* and the current values Id and Iq to calculate the control such that the current command is realized by the following equation, and outputs the output voltages Vd and Vq.

$$Vd=Gpd\times(Id^*-Id)+Gid\times S(Id^*-Id) \quad \text{(equation 6)}$$

$$Vq=Gpq\times(Iq^*-Iq)+Giq\times S(Iq^*-Iq) \quad \text{(equation 7)}$$

wherein, Vd and Vq represent d-axis voltage and q-axis voltage, Gpd and Gid represent d-axis current control proportion gain and integration gain, and Gpq and Giq represent q-axis current control proportion gain and integration gain.

Next, three phase output voltages Vu, Vv and Vw are converted and obtained by the following equation (8) such that output waveform becomes sine wave from the obtained outputs Vd and Vq in two direction using the rotor position θ estimated by a later-described method by a general two-phase/three phase conversion.

$$\begin{bmatrix} V_a \\ V_b \end{bmatrix}=\begin{bmatrix} \cos(\theta) & -\sin(\theta) \\ \sin(\theta) & \cos(\theta) \end{bmatrix}\begin{bmatrix} V_d \\ V_q \end{bmatrix} \quad \text{(equation 8)}$$

$$\begin{bmatrix} V_u \\ V_v \\ V_w \end{bmatrix}=\begin{bmatrix} \sqrt{\frac{2}{3}} & 0 \\ -\sqrt{\frac{1}{6}} & \sqrt{\frac{1}{2}} \\ -\sqrt{\frac{1}{6}} & -\sqrt{\frac{1}{2}} \end{bmatrix}\begin{bmatrix} V_a \\ V_b \end{bmatrix}$$

Here, Vu, Vv and Vw represent U-phase voltage, V-phase voltage and W-phase voltage, and 0 represents rotor position.

Further, the sine wave voltage output means 809 outputs a drive signal for driving the power generator 710 to a base driver 808 based on information of an output voltages Vd and Vq and information of the rotor position estimated by the rotor position rotation estimation means 807. The base driver 808 outputs a signal for driving the switching elements 803*a*, 803*b*, 803*c*, 803*d*, 803*e*, 803*f* in accordance with the drive signal. With this, the power generator 710 is driven with the target number of revolutions (speed).

Next, the operation of the rotor position rotation estimation means 807 will be explained.

First, phase currents (iu, iv, iw) flowing through windings of the phases are obtained from currents detected by the current sensors 805*a* and 805*b*. Phase voltages (vu, vv, vw) to be applied to the windings of the phases are obtained by the following equations from the three phase duty values Du, Dv, Dw which are output from the sine wave voltage output means 809 and from power supply voltage Vdc obtained from the partial pressure resistors 813*a* and 813*b*.

$$vu=Du\times Vdc \quad \text{(equation 9)}$$

$$vv=Dv\times Vdc \quad \text{(equation 10)}$$

$$vw=Dw\times Vdc \quad \text{(equation 11)}$$

From these values, induction voltage values eu, ev, ew to be induced to the windings of the phases are obtained by the calculations of the following equations (12), (13) and (14).

$$eu=vu-R\times iu-L\times d(iu)/dt \quad \text{(equation 12)}$$

$$ev=vv-R\times iv-L\times d(iv)/dt \quad \text{(equation 13)}$$

$$ew=vw-R\times iw-L\times d(iw)/dt \quad \text{(equation 14}$$

wherein, R represents resistor, and L represents inductance. Further, d(iu)/dt, d(iv)/dt, d(iw)/dt respectively represent time differentiations of iu, iv and iw.

Next, a rotor position θ and an estimated number of revolutions ωm are estimated using the calculated induction voltage values eu, ev and ew. This is a method in which the estimated angle θm recognized by the electric motor drive apparatus is corrected using an error of the induction voltage, thereby converging the value to a real value to estimate the rotor position θ. The estimated number of revolutions ωm is also estimated from the estimated angle θm.

First, induction voltage reference values (eum, evm, ewm) of the phases are obtained using the following equations.

$$eum=em\times\sin(\theta m+\beta T)$$

$$evm=em\times\sin(\theta m+\beta T-120°)$$

$$ewm=em\times\sin(\theta m+\beta T-240°) \quad \text{(equation 15)}$$

Here, em induction voltage amplitude value em is obtained by matching with amplitude values of the induction voltage values eu, ev, ew.

Further, induction voltage reference values esm of the phases are subtracted from the induction voltage values es of the phases, and a deviation ϵ is obtained.

$$\epsilon=es-esm \quad \text{(equation 16)}$$

wherein, s represents phase (u/v/w).

If the deviation ϵ becomes 0, the estimated angle θm becomes equal to the real value. Thus, the real value of the estimated angle θm is obtained as an estimated rotor position θ (estimated magnetic pole position) by a method for converging the deviation ϵ by the PI calculation such that the deviation ϵ is converged to 0. Further, the estimated number of revolutions ωm can be estimated by calculating a variation value of the estimated angle θm. Since this estimating method is obvious for a person skilled in the art, explanation thereof will be omitted.

According to the heat pump apparatus of the embodiment, the first converter estimates the magnetic pole position and the number of revolutions of the power generator by using the current sensor or the rotor position rotation estimation means, and controls the number of revolutions of the permanent magnet type synchronization power generator having no exciting unit, i.e., the number of revolutions of the expander based on the estimated magnetic pole position and the estimated number of revolutions, and the electricity can efficiently be regenerated by the power generator connected to the expander. With this, since there is no exciting unit on the side of the rotor of the power generator, the weight of the power generator is reduced. Since there is no electricity loss which may be caused by the exciting unit, the electricity generating efficiency is enhanced, and it is possible to provide an inexpensive heat pump apparatus having a simple configuration.

In this embodiment, it is possible to know the magnetic pole position of the power generator without using the position sensor. Thus, a shaft seal for an encoder is unnecessary, the expander and the power generator can be accommodated in a hermetical integral shell, and a heat pump apparatus having high reliability (sealing ability) is realized.

Second Embodiment

Figure 3:
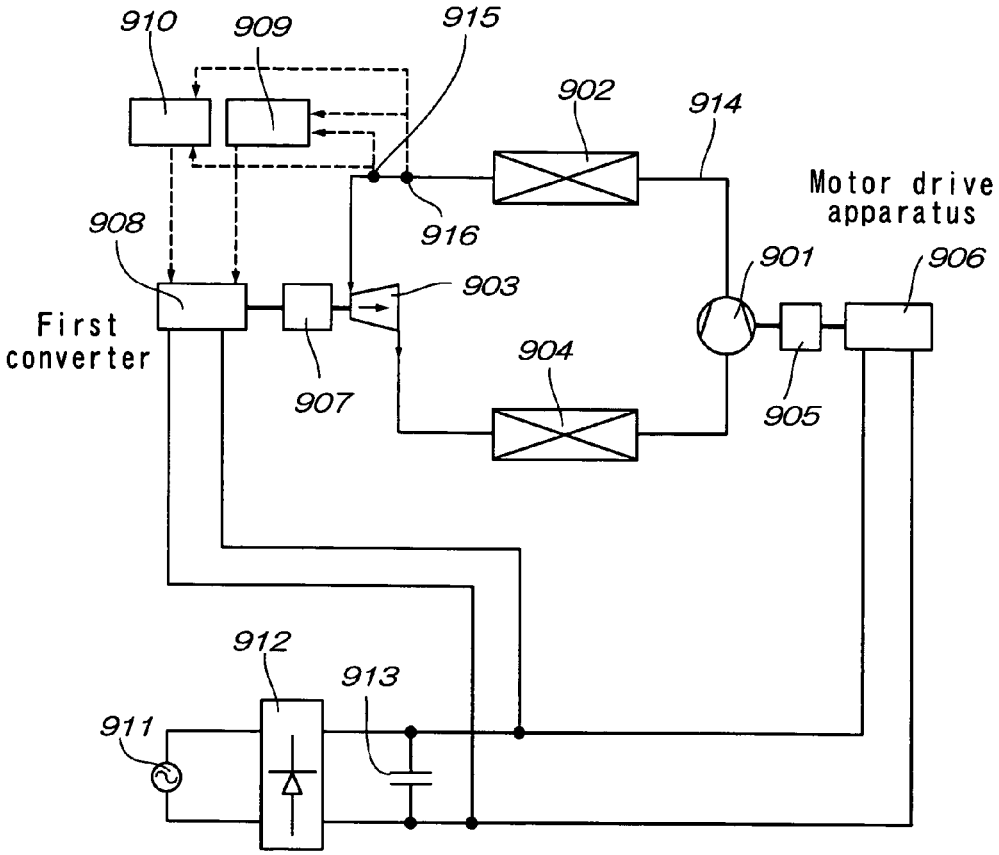
FIG. 3 is a block diagram showing a heat pump apparatus of a second embodiment of the invention.

The heat pump apparatus of the present invention used for a refrigeration cycle will be explained with reference to the drawings. FIG. 3 is a block diagram showing a heat pump apparatus of a second embodiment of the invention.

The heat pump apparatus of this embodiment includes a compressor 901 for compressing a refrigerant, a radiator 902 for cooling the refrigerant compressed by the compressor 901, an expander 903 for expanding the refrigerant which passed through the radiator 902, an evaporator 904 for vaporizing the refrigerant expanded by the expander 903, a refrigerant pipe 914 for circulating the refrigerant between the above elements, a permanent magnet type synchronization power generator 907 (power generator 907, hereinafter) connected to the expander 903, and a first converter 908. The first converter 908 has a function for converting AC power which is outputted from the power generator 907 into DC power, and a function for controlling the driving operation of the power generator 907.

The heat pump apparatus also includes an electric motor 905 for driving the compressor 901, a motor drive apparatus 906 for controlling the electric motor 905, a power supply circuit for supplying DC power converted from an AC power supply 911 at a rectifier circuit 912 and a smoothing capacitor 913 and DC power from the first converter 908 to the electric motor 905 through the motor drive apparatus 906, and a control circuit having expander number of revolutions determining means 909, expander actuating means 910, a pressure sensor 915 for detecting pressure of a refrigerant, and a temperature sensor 916 for detecting the temperature of the refrigerant. The control circuit outputs a signal to the first converter 908.

The pressure sensor 915 and the temperature sensor 916 are disposed between the compressor 901 and the expander 903 located on the high pressure side of a heat pump cycle. In the case of this embodiment, they are provided at an outlet of the radiator 902.

The first converter 908 connected to the power generator 907 has the same configuration as that of the first converter 708 of the first embodiment and thus, explanation thereof will be omitted.

Next, the operation of the configuration will be explained.

In FIG. 3, a refrigerant is compressed by the compressor 901 driven by the electric motor 905 and the motor drive apparatus 906, and is cooled by the radiator 902. Then, when the refrigerant passes through the expander 903, the refrigerant is expanded, thereby rotating the power generator 907 connected to the expander 903. The heat of the refrigerant expanded in the expander 903 is absorbed from outside in the evaporator 904 and the refrigerant is vaporized. Then, the refrigerant returns to the compressor 901 again. This closed circuit is connected through the refrigerant pipe 914.

Voltage of DC is rectified an input from the AC power supply 911 in the rectifier circuit 912, and is smoothened by the smoothing capacitor 913, and then, is converted into three phase AC by the motor drive apparatus 906. With this, the electric motor 905 is driven. By driving the electricity motor 905, the compressor 901 performs the compressing function. A torque of the expander 903 generated by the expanding force of the refrigerant becomes a rotation force of the power generator 907, and electricity is generated. The electricity generated by the power generator 907 is converted into DC by the first converter 908, and is supplied to both ends of the smoothing capacitor 913. The electricity generated by the power generator 907 connected to the expander 903 is used as an auxiliary power for driving the motor of the compressor 901.

Here, the number of revolutions of the power generator 907, i.e., the expander 903 is controlled by the first converter 908. The number of revolutions of the compressor 901 is controlled by the motor drive apparatus 906.

A target number of revolutions is given to the first converter 908 from the expander number of revolutions determining means 909. The expander number of revolutions determining means 909 determines optimal number of revolutions (target number of revolutions) of the expander based on the outlet pressure and the outlet temperature of the radiator 902 detected by the pressure sensor 915 and the temperature sensor 916. This optimal number of revolutions of the expander is determined by data of efficiency of the refrigeration cycle with respect to the outlet pressure and the outlet temperature of the radiator shown in FIG. 4.

Figure 4:
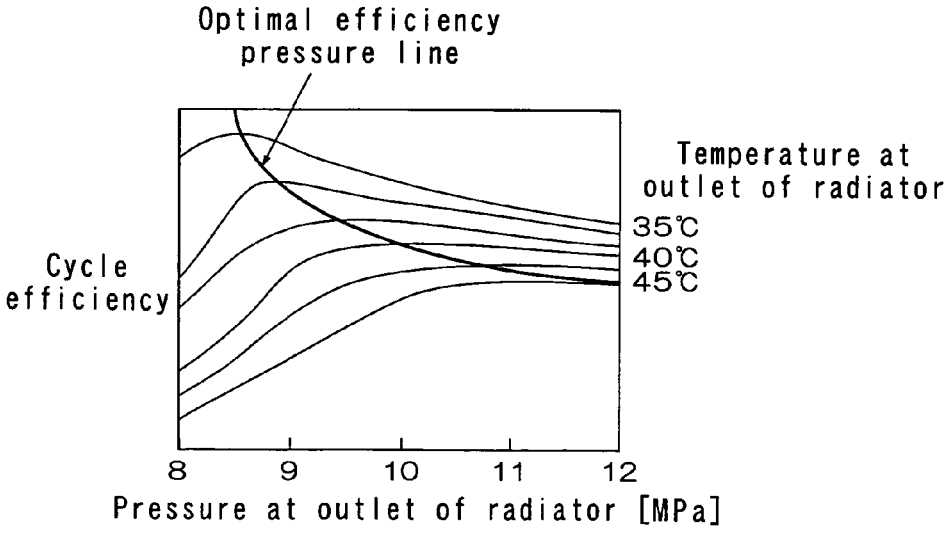
FIG. 4 is a diagram showing one example of efficiency of a refrigeration cycle with respect to pressure and temperature of a radiator outlet.

As shown in FIG. 4, the efficiency of the refrigeration cycle has different points at which the efficiency becomes maximum depending upon the outlet pressure and the outlet temperature, and a line connecting these points is a maximum efficiency pressure line. By measuring the outlet temperature of the radiator using this pressure line, the optimal pressure as the outlet pressure of the radiator at that time is obtained.

Figure 5:
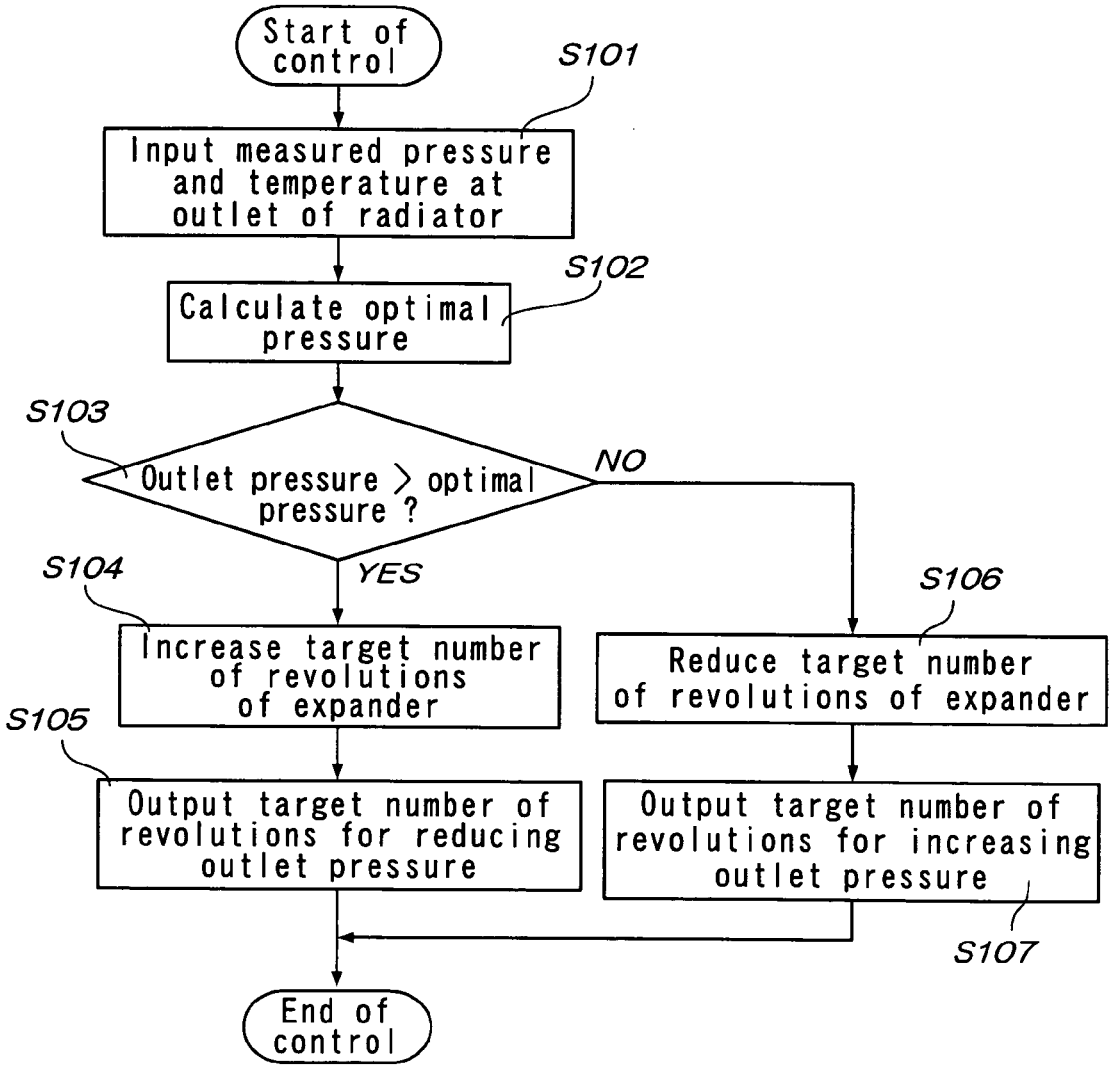
FIG. 5 is a flowchart for determining the number of revolutions of an expander in the heat pump apparatus shown in FIG. 3.

Next, the operation of the expander number of revolutions determining means 909 will be explained. FIG. 5 is a flowchart for determining the number of revolutions of an expander in the heat pump apparatus shown in FIG. 3, and shows the determining procedure of the number of revolutions of the expander with which the cycle efficiency in the expander number of revolutions determining means 909 is maximized.

First, in step 101, the measured pressure and temperature of the outlet of the radiator are input. Then, the optimal pressure under which the efficiency is maximized is calculated in accordance with data of the optimal pressure shown in FIG. 4 (step 102). Then, it is determined whether the measured current outlet pressure is greater than the optimal pressure in step 103. When the outlet pressure is greater than the optimal pressure, the target number of revolutions of the expander 903 is increased so as to reduce the outlet pressure (step 104). For example, a later-described initial number of revolutions command n1 is defined as an initial value, calculation for increasing the initial value is carried out, and this is replaced by a target number of revolutions for next control. Then, a target number of revolutions for reducing the outlet pressure is output to the first converter 908 (step 105). With this, a pressure difference between inlet and outlet of the expander 903 is reduced and as a result, the pressure of the high pressure side in the refrigeration cycle is reduced.

When the outlet pressure is smaller than the optimal pressure, the target number of revolutions of the expander 903 is reduced so as to increase the outlet pressure (step 106). Then a target number of revolutions for increasing the outlet pressure is output to the first converter 908 (step 107). With this, the pressure difference between inlet and outlet of the expander 903 is increased and as a result, the pressure of the high pressure side in the refrigeration cycle is increased.

By repeating these controls, the outlet pressure of the radiator 902 becomes equal to a predetermined optimal pressure under which the efficiency of the refrigeration cycle is maximized.

The step 102 corresponds to optimal value calculating means which calculates optimal pressure from data of outlet pressure, outlet temperature and optimal pressure of the radiator.

As described above, according to the heat pump apparatus of the embodiment, the first converter 908 controls the number of revolutions of the power generator 907 (i.e., number of revolutions of the expander 903) such that the pressure of the refrigerant becomes equal to the predetermined optimal pressure based on the target number of revolutions from the expander number of revolutions determining means 909. With this, it is possible to optimize the cycle efficiency of the heat pump apparatus.

The cycle efficiency is optimized by this embodiment, the coefficient of performance (COP) is enhanced and thus, carbon dioxide can be used for the heat pump apparatus as a refrigerant, and this is of help in preventing the global warming.

Figure 6:
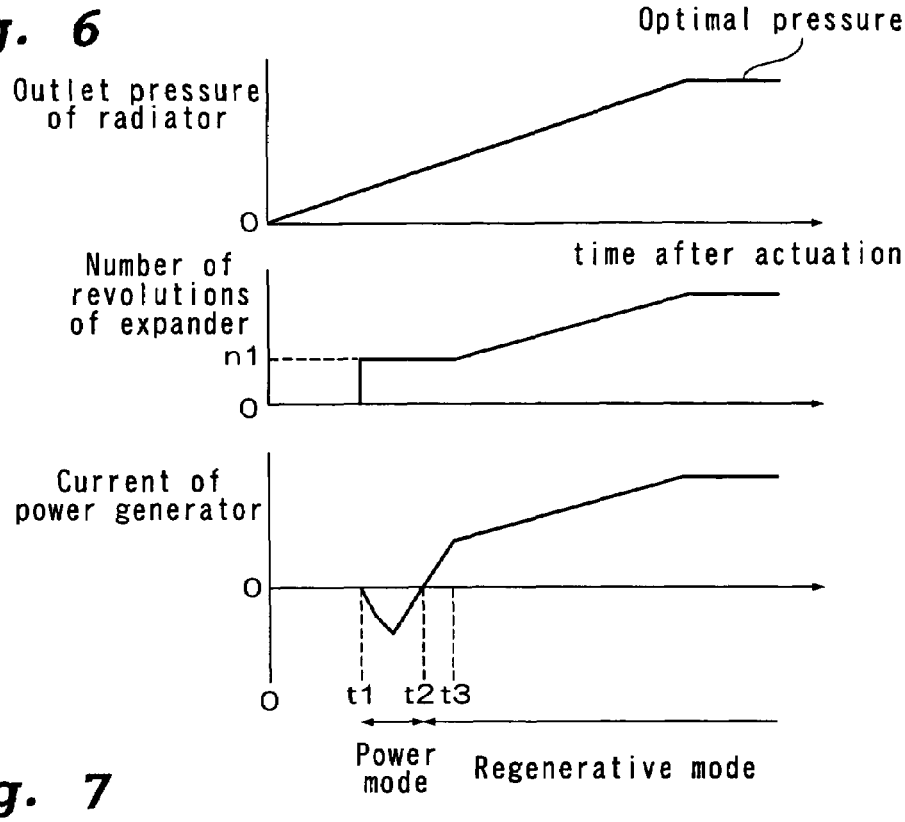
FIG. 6 is a diagram showing a state transition at the time of actuation of the expander in the heat pump apparatus shown in FIG. 3.

Next, the operation of the expander actuating means 910 will be explained. FIG. 6 is a diagram showing a state transition at the time of actuation of the expander in the heat pump apparatus shown in FIG. 3, and shows setting sequence of the number of revolutions at the time of actuation in the expander actuating means 910. That is, FIG. 6 shows an example of transition of the radiator outlet pressure, the number of revolutions of the expander and the current of the power generator from the actuation to a steady state.

In FIG. 6, at the time of actuation of the heat pump apparatus, the number of revolutions of the compressor 901 starts increasing, and the radiator outlet pressure starts increasing gradually. At that time, during a period from the actuation of the compressor 901 to time t1, control for bringing current flowing through the power generator 907 to zero (±0) is performed by the first converter 908, and an electricity generation stopping operation in which no load torque is applied to the power generator 907 is carried out.

That is, the heat pump apparatus has a function for starting the electricity generating operation of the power generator 907 by the first converter 908 at the time t1 at which a predetermined time is elapsed after the actuation of the compressor 901. During this period, thus, the expander 903 is smoothly rotated and its original expansion function is exhibited so that the heat pump system can start swiftly.

Then, at the timing of the time t1, the initial number of revolutions command (initial value of the target number of revolutions) of the expander 903 is set as n1. With this, the driving of the power generator 907 in a power mode exceeding the actuation load of the expander 903 is realized, and the expander 903 rotates smoothly.

During a period from the time t1 to time t2 at which expansion force is sufficiently obtained, the first converter 908 controls such that the current of the power generator 907 in the expander 903 flows toward the power side, i.e., in the direction of the power generator 907 from the power supply circuit (minus current direction in which electricity is input to the power generator). That is, the first converter 908 has a function for driving the power generator 907 in the power mode. At the time of actuation, thus, the expander using the power generator as the electric motor is forcibly rotated, the expander 903 is actuated smoothly, and the reliability of the refrigeration cycle is enhanced.

After the time t2 in which the expansion force is increased, the first converter 908 controls such that the current of the power generator 907 flows toward the regenerative side, i.e., from the power generator 907 toward the power supply circuit (toward the plus current direction in which electricity is output from the power generator). With this, the driving of the power generator 907 in the regenerative mode is realized, and the electricity recovery by the power generator 907 is started.

From time t3, control is performed such that the setting of the initial number of revolutions command n1 is released, the expander number of revolutions determining means 909 is allowed to output a normal target number of revolutions, and the outlet pressure is brought into the optimal pressure. That is, a steady operation is carried out, the outlet pressure of the radiator, the number of revolutions of the expander and the current of the power generator are gradually increased, and they reach the optimal pressure, the target number of revolutions, and the target current, respectively.

As described above, according to this embodiment, by the electricity generation stopping operation of the power generator 907 at the time of actuation and the power mode driving, the system is swiftly started, and the expander 903 is smoothly actuated, and a reliably heat pump apparatus is provided. The power generator may be driven in the power mode simultaneously with the actuation of the compressor without providing the differential time, and even with this configuration, the same effect can be obtained.

Third Embodiment

Figure 7:
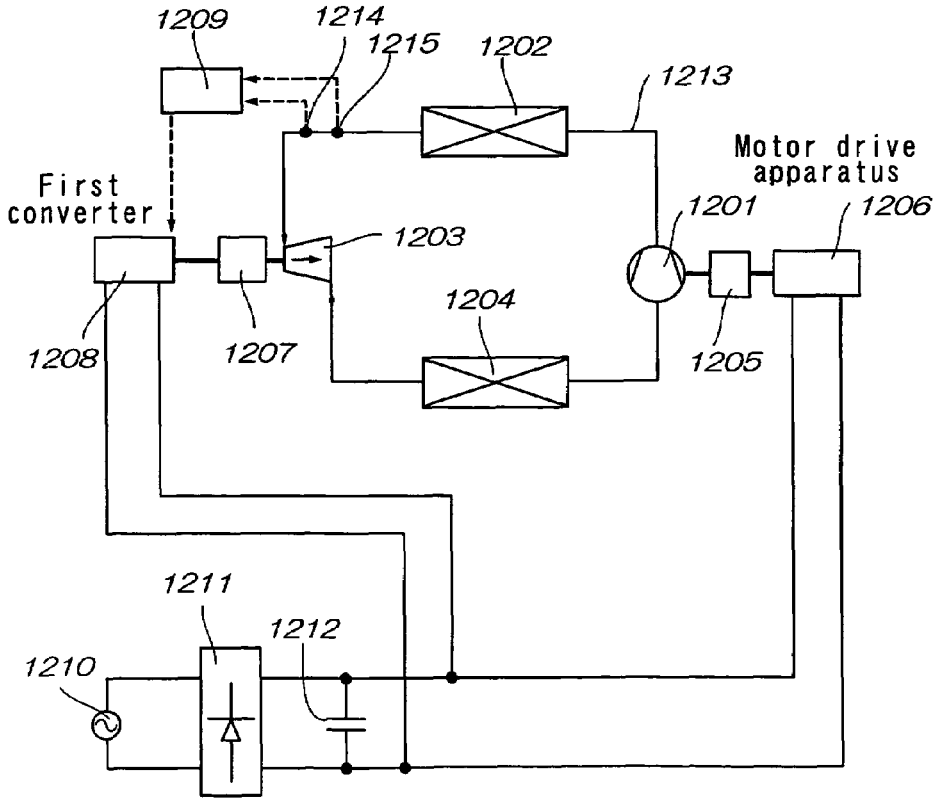
FIG. 7 is a block diagram showing a heat pump apparatus of a third embodiment of the invention.

Another embodiment in which the heat pump apparatus of the present invention is used in a refrigeration cycle will be explained with reference to the drawing. FIG. 7 is a block diagram showing the heat pump apparatus of a third embodiment of the invention.

The heat pump apparatus of this embodiment includes a compressor 1201 for compressing a refrigerant, a radiator 1202 for cooling the refrigerant compressed by the compressor 1201, an expander 1203 for expanding the refrigerant which passed through the radiator 1202, an evaporator 1204 for vaporizing the refrigerant expanded by the expander 1203, a refrigerant pipe 1214 for circulating the refrigerant between the above elements, a permanent magnet type synchronization power generator 1207 (power generator 1207, hereinafter) connected to the expander 1203, and a first converter 1208. The first converter 1208 has a function for converting AC power which is outputted from the power generator 1207 into DC power, and a function for controlling the driving operation of the power generator 1207.

The heat pump apparatus also includes an electric motor 1205 for driving the compressor 1201, a motor drive apparatus 1206 for controlling the electric motor 1205, a power supply circuit for supplying DC power converted from an AC power supply 1210 at a rectifier circuit 1211 and a smoothing capacitor 1212 and DC power from the first converter 1208 to the electric motor 1205 through the motor drive apparatus 1206, and a control circuit having power generator current determining means 1209, a pressure sensor 1214 for detecting the pressure of a refrigerant at the outlet of the radiator 1202, and a temperature sensor 1215 for detecting the temperature of the refrigerant at the outlet of the radiator 1202. The control circuit outputs a signal to the first converter 1208.

Figure 8:
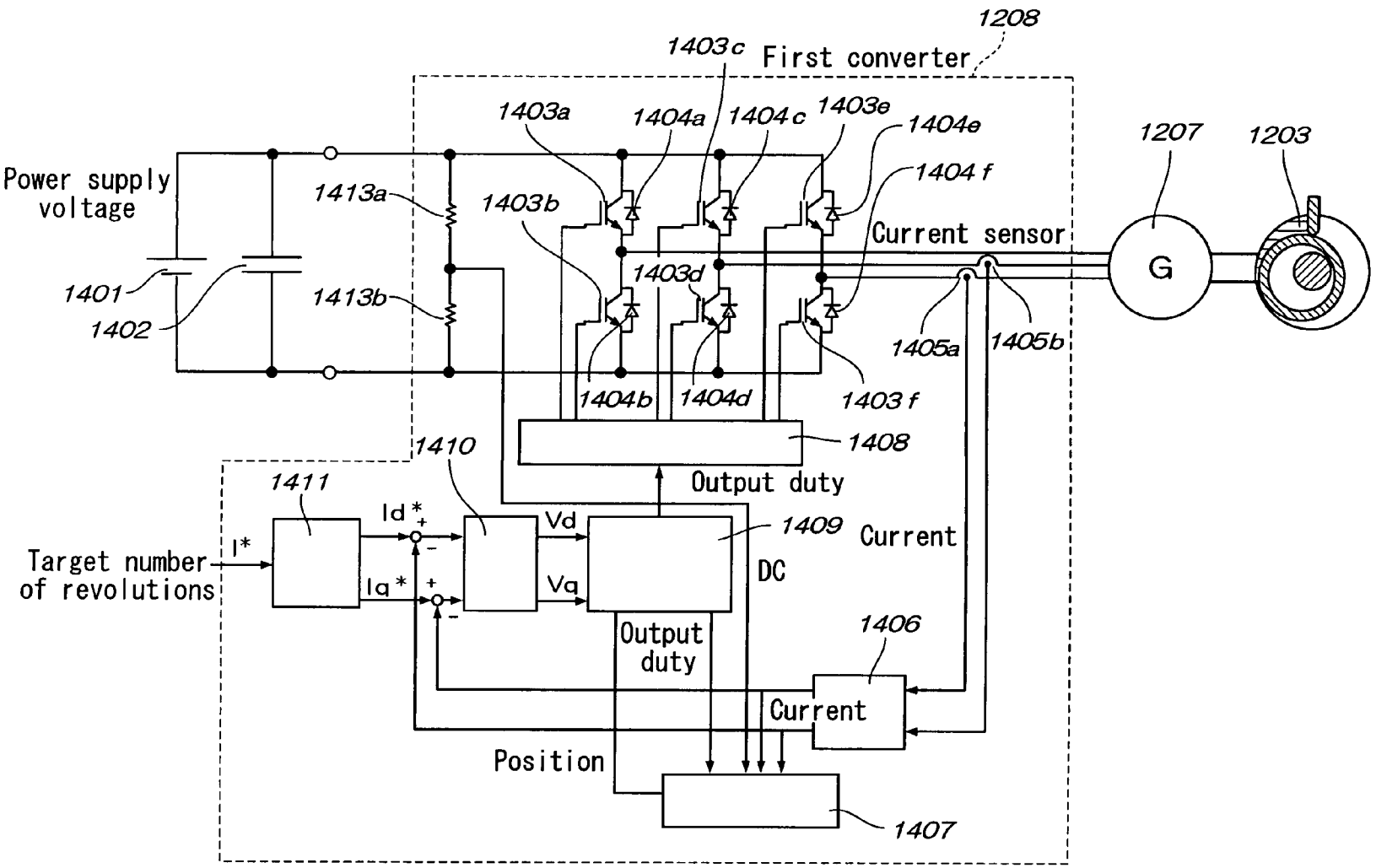
FIG. 8 is a detailed block diagram of a first converter of the heat pump apparatus shown in FIG. 7.

Next, a configuration of the first converter which controls the current of the power generator connected to the expander will be explained. FIG. 8 is a detailed block diagram of a first converter of the heat pump apparatus shown in FIG. 7.

The first converter 1208 includes two current sensors 1405*a* and 1405*b;* a conversion circuit having pairs of switching elements 1403*a,* 1403*b,* 1403*c,* 1403*d,* 1403*e,* 1403*f* and free wheel diodes 1404*a,* 1404*b,* 1404*c,* 1404*d,* 1404*e,* 1404*f;* and a control circuit having dual axis current conversion means 1406, rotor position rotation estimation means 1407, a base driver 1408, sine wave voltage output means 1409, current controller 1410, and current command forming means 1411. In the drawing, symbols 1413*a* and 1413*b* represent partial pressure resistors.

The three phase AC generated output of power generator 1207 is connected such that it is supplied to a DC power supply 1401 and a smoothing capacitor 1402 through the first converter 1208. Here, the DC power supply 1401 and the smoothing capacitor 1402 correspond to the rectifier circuit 1211 and the smoothing capacitor 1212 in FIG. 7. The three phase AC output is converted into DC by the first converter 1208. At that time, the current of the power generator 1207 is controlled such that it becomes equal to the target current based on the information of the target current given from outside.

That is, the switching patterns of the switching elements 1403*a* to 1403*f* of the first converter 1208 is determined from information of the magnetic pole position of the power generator 1207 estimated from the current information of the power generator 1207 obtained from the current sensors 1405*a* and 1405*b,* information of the current of the power generator 1207, and information of the target current given from outside. Further, the switching pattern signal is converted into a drive signal for electrically driving the switching elements 1403*a* to 1403*f,* and the switching elements 1403*a* to 1403*f* are operated in accordance with the drive signals.

To realize the target current given from outside, the current command forming means 1411 calculates d-axis current command Id* and q-axis current command Iq* for realizing a current phase angle by the following equations.

$$Id^*=I^*\times\sin(\beta) \quad \text{(equation 3)}$$

$$Iq^*=I^*\times\cos(\beta) \quad \text{(equation 4)}$$

wherein, I* represents current command, and β represents current phase angle.

A method for realizing the d-axis current command Id* and the q-axis current command Iq* is the same as that of the first converter 708 shown in the first embodiment. With this configuration, the control of the current of the power generator 1207 can be realized.

Next, the operation of the above configuration will be explained.

In FIG. 7, a refrigerant is compressed by the compressor 1201 driven by the electric motor 1205 and the motor drive apparatus 1206, and is cooled by the radiator 1202. Then, when the refrigerant passes through the expander 1203, the refrigerant is expanded, thereby rotating the power generator 1207 connected to the expander 1203. The heat of the refrigerant expanded in the expander 1203 is absorbed from outside in the evaporator 1204 and the refrigerant is vaporized. Then, the refrigerant returns to the compressor 1201 again. This closed circuit is connected through the refrigerant pipe 1213.

Voltage of the DC is rectified an input from the AC power supply 1210 to AC in the rectifier circuit 1211, is smoothened by the smoothing capacitor 1212, and then, is converted into three phase AC by the motor drive apparatus 1206. With this, the electric motor 1205 is driven. By driving the electricity motor 1205, the compressor 1201 performs the compressing function. The power generator 1207 is rotated by the expansion force of the refrigerant through the expander 1203 to generate electricity. The electricity generated by the power generator 1207 is converted into DC by the first converter 1208 and then it is supplied to the smoothing capacitor 1212 and the electric motor 1205. The electricity generated by the power generator 1207 is used as an auxiliary power for driving the motor of the compressor 1201.

In this embodiment, the first converter 1208 controls a torque of the expander 1203. That is, a target current of the power generator 1207 is given from the power generator current determining means 1209. The power generator current determining means 1209 determines the optimal power generator current (target current) by outlet temperature and outlet pressure of the radiator 1202 detected by the temperature sensor 1215 and the pressure sensor 1214. This optimal power generator current is determined by data of efficiency of the refrigeration cycle with respect to the outlet pressure and the outlet temperature of the radiator shown in FIG. 4, and is obtained such that the efficiency of the refrigeration cycle is maximized.

Figure 9:
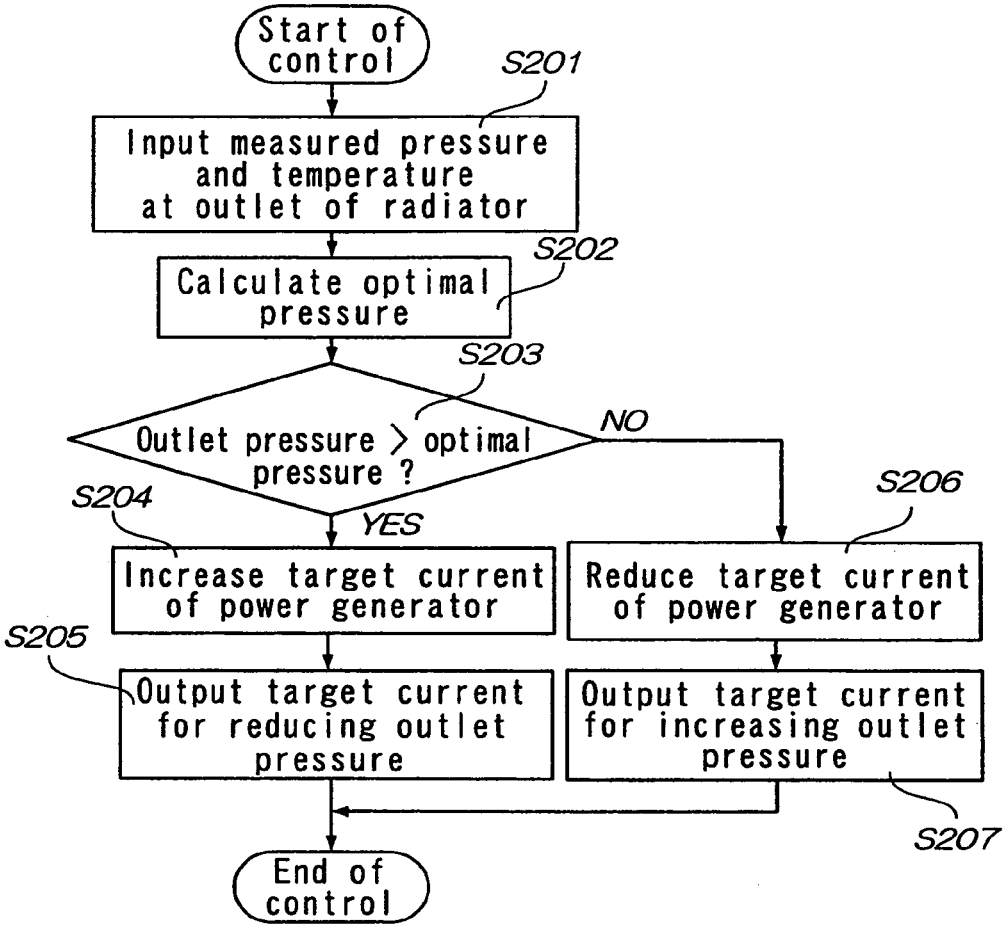
FIG. 9 is a flowchart for determining current of a power generator in the heat pump apparatus shown in FIG. 7.
Figure 10:
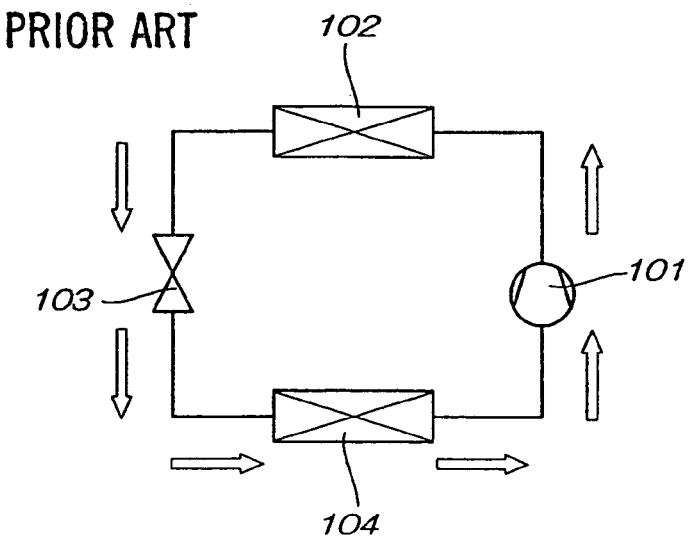
FIG. 10 is a block diagram showing a conventional vapor-compression type refrigerator.
Figure 11:
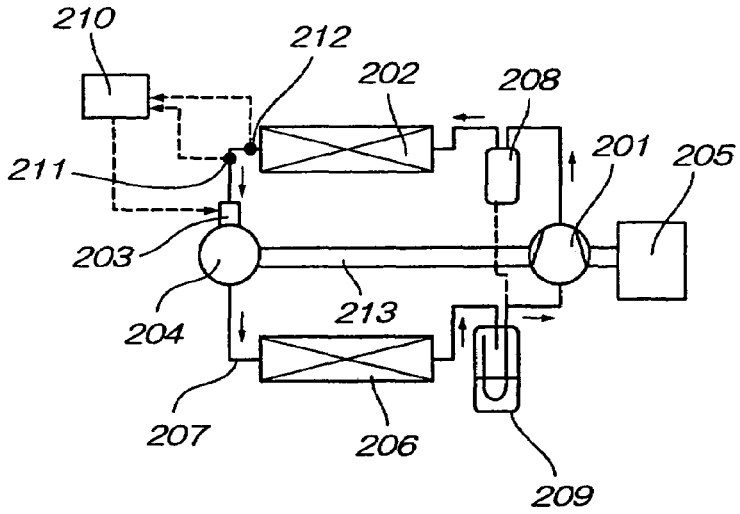
Fig. 11 PRIOR ART
FIG. 11 is a block diagram showing the conventional refrigerator.
Figure 12:
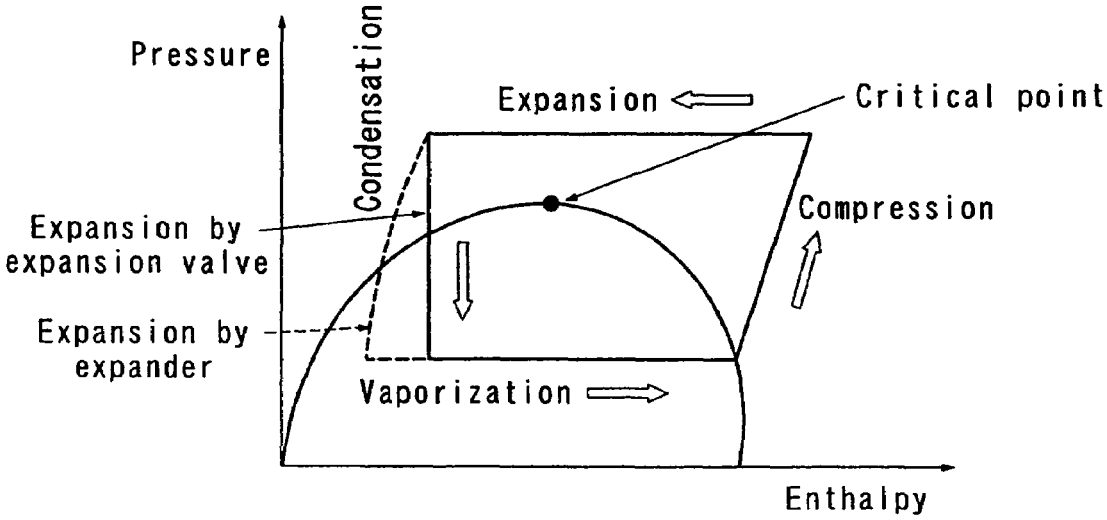
Fig. 12 PRIOR ART
FIG. 12 is a Mollier diagram showing a state of a refrigerant in a refrigeration cycle using carbon dioxide.
Figure 13:
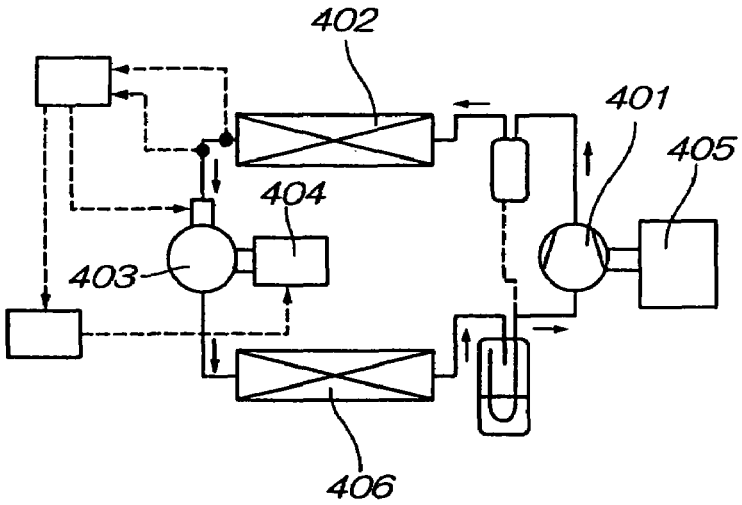
Fig. 13 PRIOR ART
FIG. 13 is a block diagram showing another conventional refrigerator.
Figure 14:
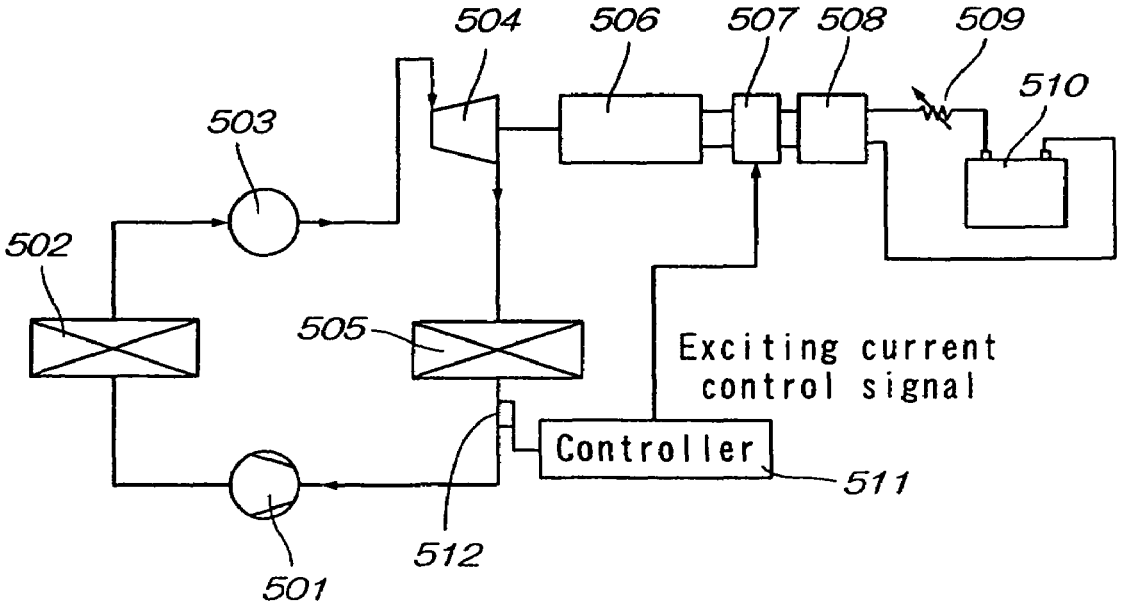
Fig. 14 PRIOR ART
FIG. 14 is a block diagram showing another conventional refrigerator.
Figure 15:
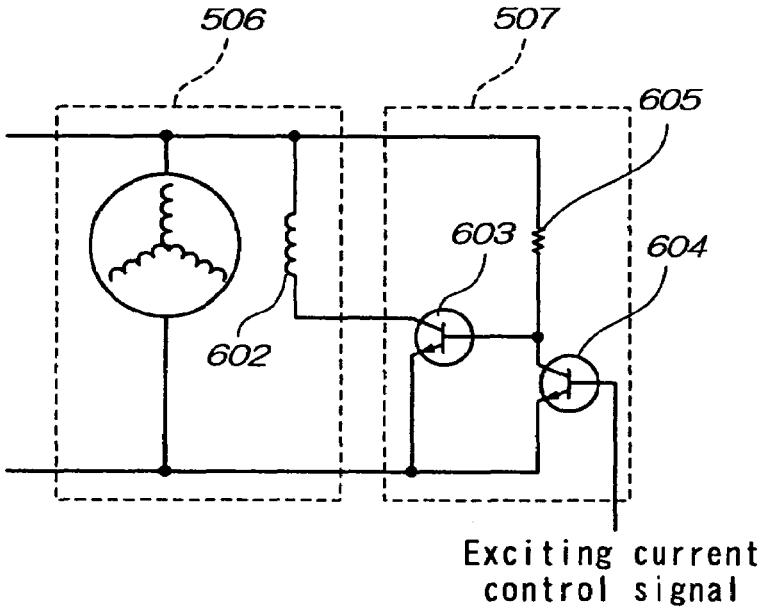
Fig. 15 PRIOR ART
FIG. 15 is a circuit diagram showing an exciting unit of a conventional refrigerator.

Next, the operation of the power generator current determining means 1209 will be explained. FIG. 9 is a flowchart for determining current of a power generator in the heat pump apparatus shown in FIG. 7, and shows determining procedure of the power generator current at which the cycle efficiency in the power generator current determining means 1209 is maximized.

First, instep 201, the measured pressure and temperature of the outlet of the radiator are input. Then, the optimal pressure under which the efficiency is maximized is calculated in accordance with data of the optimal pressure shown in FIG. 4 (step 202). Then, it is determined whether the measured current outlet pressure is greater than the optimal pressure in step 203. When the outlet pressure is greater than the optimal pressure, the target current of the power generator 1207 is increased so as to reduce the outlet pressure (step 204). Then, the target current for reducing the outlet pressure is output to the first converter 1208 (step 205). With this, the high pressure side pressure in the refrigeration cycle is reduced.

When the outlet pressure is smaller than the optimal pressure, the target current of the power generator 1207 is reduced so as to increase the outlet pressure (step 206). The target current for increasing the outlet pressure is output to the first converter 1208 (step 207). With this, the high pressure side pressure in the refrigeration cycle is increased.

By repeating these controls, the outlet pressure of the radiator 1202 becomes equal to a predetermined optimal pressure under which the efficiency of the refrigeration cycle is maximized.

Since the current value of the power generator 1207 represents a torque of the expander 1203, the torque of the expander is changed by the target current. The torque of the expander 1203 is determined by the pressure on the inlet side and the pressure on the outlet side of the expander 1203, and by controlling the torque of the expander 1203, the pressures of the inlet and outlet of the expander are substantially controlled. Therefore, by setting the target current of the power generator 1207 is set, it is possible to control the pressures of the inlet and outlet of the expander 1203.

As described above, according to the heat pump apparatus of the embodiment, the first converter 1208 controls the current of the power generator 1207 (i.e., torque of the expander 1203) such that the pressure of the refrigerant becomes equal to the predetermined optimal pressure based on the target current from the power generator current determining means 1209. With this, the cycle efficiency of the heat pump apparatus can be optimized. In this embodiment, to control the current of the power generator 1207 is to control the number of revolutions of the power generator 1207 by the switching control of the first converter 1208, and it is possible to widely control the expander 1203.

Instead of determining the target current by the power generator current determining means 1209, the power generator electricity determining means (not shown) may determine the target generated electricity based on the following equation. It is also effective that the amount of electricity generated by the power generator 1207 is adjusted in accordance with the optimal pressure, and the pressure of the refrigerant is brought into the optimal pressure.

$$\text{Amount of electricity } W = \text{target current} \times \text{number of revolutions} \quad \text{(equation 17)}$$

That is, the amount of electricity recovered by the power generator 1207 connected to the expander 1203 can be controlled by determining the target generated electricity.

That is, the first converter controls the generated electricity of the permanent magnet type synchronization power generator such that the pressure of the refrigerant becomes equal to the predetermined optimal pressure based on the target generated electricity from the power generator electricity determining means, thus, the cycle efficiency of the heat pump apparatus can be optimized.

Further, to control the generated electricity of the power generator 1207 is to control the number of revolutions by the switching control, and it is possible to control the expander 1203 with number of revolutions of a wide range.

In this embodiment, the current sensor measures the currents of two lines in the three phase AC of the power generator, but even if the heat pump apparatus comprises a current sensor at the DC portion of the first converter, it is clear that the same function can be realized and the same effect can be obtained.

As described above, the present invention is applied to a refrigerator having an expander, and is suitable for a heat pump type refrigerator such as air conditioner and water heater.

The invention claimed is:

1. A heat pump apparatus comprising:

a compressor for compressing a refrigerant, a radiator for cooling the refrigerant compressed by said compressor, an expander for expanding the refrigerant which passed through said radiator, an evaporator for vaporizing the refrigerant which is expanded by said expander, a refrigerant pipe for circulating the refrigerant through said compressor, said radiator, said expander and said evaporator, a permanent magnet type synchronization power generator connected to said expander, a current sensor for detecting current which flows through said permanent magnet type synchronization power generator, and a first converter which converts AC power which is output from said permanent magnet type synchronization power generator into DC power, which estimates a magnetic pole position of said permanent magnet type synchronization power generator by a current value detected by said current sensor, and which controls the number of revolutions of said permanent magnet type synchronization power generator to a predetermined value by using the current value and the magnetic pole position, wherein the power generator is actuated in a power mode by said first converter when a predetermined time is elapsed after said compressor is actuated.

2. The heat pump apparatus according to claim 1, wherein said first converter estimates a magnetic pole position and the number of revolutions of said permanent magnet type synchronization power generator by a current value detected by said current senor, and controls the current value and the number of revolutions of said permanent magnet type synchronization power generator to predetermined values by using the current value, the magnetic pole position and the number of revolutions.

3. The heat pump apparatus according to claim 1, further comprising a second converter for converting AC of commercial power supply to DC, and an inverter which connects DC output from said first and second converters to an input end of said inverter to convert the DC into AC having predetermined frequency, and which drives said compressor.

4. The heat pump apparatus according to claim 1, further comprising:

a pressure sensor and a temperature sensor which are disposed between said compressor and said expander and which respectively detect pressure and temperature of said refrigerant, and power generator current controller for controlling a current value of said power generator by signals from said pressure sensor and said temperature sensor such that the pressure of said refrigerant becomes optimal pressure.

5. The heat pump apparatus according to claim 1, further comprising:

a pressure sensor and a temperature sensor which are disposed between said compressor and said expander and which respectively detect pressure and temperature of said refrigerant, and power generator generated electricity amount controller for controlling an amount of generated electricity of said power generator by signals from said pressure sensor and said temperature sensor such that the pressure of said refrigerant becomes optimal pressure.

6. The heat pump apparatus according to claim 1, wherein the refrigerant is carbon dioxide.

7. The heat pump apparatus according to claim 1, further comprising:

a pressure sensor disposed between said compressor and said expander for detecting pressure of the refrigerant, a temperature sensor disposed between said compressor and said expander for detecting temperature of the refrigerant, and power generator revolution number controller from controlling said first converter by signals from said pressure sensor and said temperature sensor after the predetermined time is elapsed.

* * * * *